United States Patent [19]

Wilmore et al.

[11] Patent Number: 4,710,991

[45] Date of Patent: Dec. 8, 1987

[54] HEADREST PILLOW

[76] Inventors: Scott H. Wilmore, 7027 Woodland Dr., Eden Prairie, Minn. 55344; Ronald D. Robinson, 3819 Tonkawood Rd., Minnetonka, Minn. 55345

[21] Appl. No.: 820,105

[22] Filed: Jan. 21, 1986

[51] Int. Cl.[4] ..... A47C 20/02

[52] U.S. Cl. ..... 5/435; 5/434; 5/441; 128/68; 128/76 R; 272/144

[58] Field of Search ..... 128/68, 69, 70; 5/434, 5/435, 436, 437, 441, 450, 451; 297/391; 272/94, 95, 130, 144; 623/37

[56] References Cited

U.S. PATENT DOCUMENTS

| | | | |
|---|---|---|---|
| 2,688,142 | 9/1954 | Jensen | 5/435 |
| 3,140,497 | 7/1964 | Carswell | 5/435 |
| 3,308,491 | 3/1967 | Spence | 5/450 |
| 3,608,961 | 9/1971 | Von Heck | 128/68 X |
| 3,694,831 | 10/1972 | Treace | 5/435 |
| 3,858,379 | 1/1975 | Graves et al. | 128/68 X |
| 3,926,181 | 12/1975 | Eischen, Sr. | 128/68 |
| 3,946,452 | 3/1976 | Eary, Sr. | 5/435 |
| 3,983,587 | 10/1976 | Gorran | 5/441 |
| 4,221,213 | 9/1980 | Gregory et al. | 128/70 |
| 4,382,306 | 5/1983 | Lickert | 5/441 X |
| 4,405,129 | 9/1983 | Stuckey | 5/441 X |
| 4,588,229 | 5/1986 | Jay | 5/450 X |

FOREIGN PATENT DOCUMENTS

| | | | |
|---|---|---|---|
| 2026315 | 2/1980 | United Kingdom | 5/441 |

*Primary Examiner*—Edgar S. Burr
*Assistant Examiner*—Moshe I. Cohen
*Attorney, Agent, or Firm*—Palmatier & Sjoquist

[57] ABSTRACT

A pillow for a headrest having a pair of opposing lateral head supports pads each having inner opposing and top surfaces for supporting the head. Alternatively, the pillow may be used for supporting and immobilizing the cervical spine of a person in a supine position. The pillow preferably includes three layers of plastic film sealed together about their periphery forming a closed upper chamber and a closed lower chamber. Two baffles preferably extend the width of the lower chamber thereby forming longitudinally oriented outer, intermediate and inner lower subchambers. All chambers and subchambers are appropriately filled with a viscous gel.

22 Claims, 16 Drawing Figures

HEADREST PILLOW

FIELD OF THE INVENTION

This invention relates to head and neck support and immobilization devices. More particularly, this invention relates to a pillow for a headrest typically having a pair of opposing lateral head support pads for engagement and support of opposite sides of a human head. Alternatively, the pillow is readily adaptable for supporting and immobilizing the cervical spine of a person while in the supine position as when reclining in a dental chair or the like.

Therapeutic tables upon which a human body may be supported are commonly known for orthopedic and chiropractic treatment purposes. Typically such tables include ankle, leg and pelvic, thoracic, and lumbar body support cushions. A headrest is also commonly part of such tables as shown in U.S. Pat. No. 4,221,213. Such headrests typically include two opposing rectangular members or head support pads for engaging and supporting opposite sides of the patient's head. The pads commonly are comprised of foam rubber, felt, deformable beads or polyurethane foam. The pads are also frequently covered with a plastic or leather durable covering.

Other types of headrests used to support a person's head while lying on one's back (supine position) or on one's stomach (prone position) may be seen in U.S. Pat. Nos. 2,688,142; 3,140,497; 3,694,831; 3,926,181 and 3,946,452. These headrests are either U-shaped in structure or include a pair of opposing lateral head support pads each having inner opposing and top surfaces for engagement and support of opposite sides of a person's head.

All known headrests are used to immobilize and support the head while permitting relaxation of the neck (cervical) and/or back (dorsal) muscles and ligaments which may be necessary for certain orthopedic or chiropractic treatments without hindering the person's breathing.

While the person is in the prone position, support of the head is substantially concentrated on the check bones in the face. That is, the cheek bones which slightly protrude from the head, bear most of the head's weight while being supported by the head support pads. As mentioned, known head support pads typically are firm and do not distribute this uneven concentration of supportive forces exerted on the cheek bones. With extended or repeated use of the headrest, discomfort will eventually result. Long term continuous use of such headrests may even result in pressure necrosis, including decubital ulcers, commonly referred to as bed sores.

Attempts have been made at creating a softer or more resilient pad to accommodate these uneven forces upon the head and other portions of the body where applicable. Before mentioned U.S. Pat. No. 2,688,142 discloses an inflatable headrest that may be inflated to the desired hardness. Low density, deformable beads are known to be used within cushions as shown in U.S. Pat. No. 3,608,961. High viscous gels have also been used within cushions, as taught in U.S. Pat. No. 3,308,491. U.S. Pat. No. 3,858,379 discloses a process for making such gels.

Past efforts generally involve constructions of new pads or headrests without consideration as to how present pads and headrests may be modified to more comfortably immobilize and support a person's head.

SUMMARY OF THE INVENTION

A pillow for a headrest having a pair of opposing lateral head support pads each having inner opposing and top surfaces for supporting the head. Alternatively, the pillow may be used for supporting and immobilizing the cervical spine of a person in a supine position. The pillow preferably includes three layers of plastic film sealed together about their periphery forming a closed upper chamber and a closed lower chamber. Two baffles preferably extend the width of the lower chamber thereby forming longitudinally oriented outer, intermediate and inner lower subchambers. All chambers and subchambers are appropriately filled with a viscous gel.

The pillow is appropriately attached to the inner and top surfaces of one of the lateral head support pads so that the inner subchamber is adjacent the inner surface of the head support pad while the outer subchamber is adjacent the top surface of the head support pad. A second like pillow is also attached to the other opposing head support pad in a similar manner.

A pair of headrest pillows suitably attached to the lateral opposing head support pads of a conventionally known headrest advantageously provides for a more even distribution of support and weight forces between the headrest and head thereby making the conventional headrest more comfortable to the user. This is particularly desirable where extended, long term or repeated use of such headrests becomes necessary as in orthopedic, chiropractic or other medical treatments.

Alternatively, the pillow may be appropriately attached to the front top portion of the back support cushion of a conventional dental chair or other like body supporting device. That is, the pillow is to be aligned so that it will contact the back of the neck or cervical spine. This arrangement advantageously provides comfortable support of the cervical spine between the first thoracic and second cervical vertebrae while a person is in the supine position.

The viscous gel, multiple chamber construction and baffle arrangement aid in immobilizing the head or neck which may be necessary for surgery, x-ray, chiropractic adjustments, dental treatments or other medical therapy.

The headrest pillow is simple and inexpensive to manufacture and is readily attachable to most of all known headrests, therapeutic tables, chairs and back support devices without any interference with their moving parts.

DESCRIPTION OF THE PREFERRED EMBODIMENT

Figure 1:
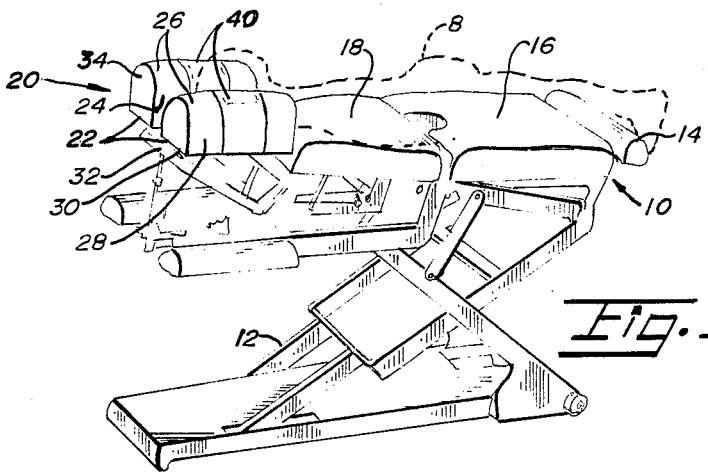
FIG. 1 is a perspective view of a therapeutic table having a headrest with pillows of the invention attached thereto.

As shown in FIG. 1, two like pillows 40 of the invention are attached to a headrest 20 which is part of a conventional therapeutic table 10 with a person 8 in a prone position thereon. Table 10 typically includes base 12 which adjustably supports ankle cushion 14, leg and pelvic cushion 16, thoracic and lumbar cushion 18 and headrest 20.

Figure 2:
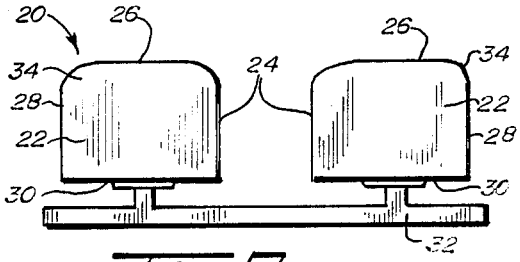
FIG. 2 is a front elevational view of the headrest.
Figure 3:
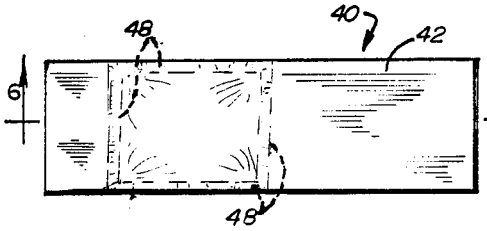
FIG. 3 is a top view of the pillow adapted for a headreast.
Figure 4:
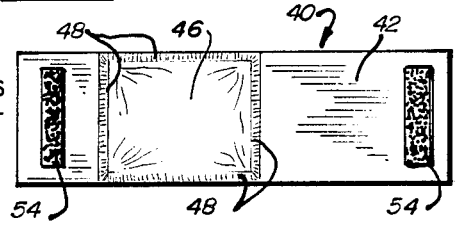
FIG. 4 is a bottom view of the pillow.
Figure 5:
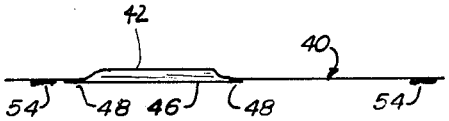
FIG. 5 is a side elevational view of the pillow.
Figure 6:
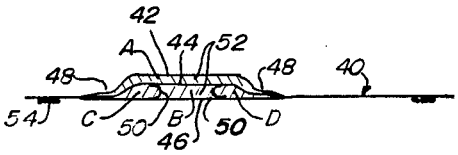
FIG. 6 is a cross sectional view of the pillow taken along lines 6—6 of FIG. 3.

Referring to FIGS. 1 and 2, headrest 20 suitably includes a pair of like laterally opposing head support pads 22. Pads 22 each have an inner face 24, a top face 26 and an outer face 28 with a support base 30 suitably made of wood or the like. Support base 30 is connected to table 10 by headrest support frame 32. Head support pads 22 are typically made of felt, foam rubber or polyurethane foam 33, as is well known, and are appropriately covered by a leather or other durable synthetic outer covering 34.

It is initially to be understood that pillow 40 is specifically described herein with headrest 20 of therapeutic table 10 for illustrative purposes. That is, pillow 40 may be utilized with a variety of headrests attached or unattached to table 10, such as those previously mentioned, whether the person or user is lying upon his/her back or in a prone position for whatever purposes. Additionally, pillows 40 may be incorporated within outer covering 34 during the manufacture of individual head support pads 22.

Referring to FIGS. 3, 4, 5 and 6, pillow 40 includes top plastic film 42 suitably having a predetermined length and width dependent upon the particular style and dimensions of headrest 40 to be used therewith. Intermediate plastic film 44, similarly having a predetermined length and width, is suitably fused or sealed about its periphery 48, preferably below first film 42, by a conventional method such as heat sealing, fusing, impulse sealing or the like. Closed upper chamber A is thereby formed by this arrangement.

Similarly, bottom plastic film 46 having a predetermined length and width is suitably fused or sealed about periphery 48 to intermediate plastic film 44. Plastic film baffles or walls 50 are also suitably fused to and preferably extend along the entire width of intermediate and bottom plastic films 44 and 46 thereby forming closed logitudinally oriented outer lower subchamber D, intermediate lower subchamber B and inner lower subchamber C.

Plastic films 42, 44, 46 and 50 suitably may be of a linear low-density nylon or a nylon with a heavy sealant and extrusion coating on both its sides. Plastics of this type are manufactured and sold by Crown-Zellerbach of Minneapolis, Minn., under the trade name "CROWN-LAM 5155". However, it is believed that other known plastics may be suitably used in practicing this invention.

Top chamber A and outer, intermediate and inner lower subchambers D, B and C are suitably filled with a viscous gel which exhibits a low displacement as a function of time (viscous creep). Such gels which may be utilized in pillow 40 are organosiloxanes, colloids, ethylene glycol gel and polyvinyl alcohol gel.

Figure 8:
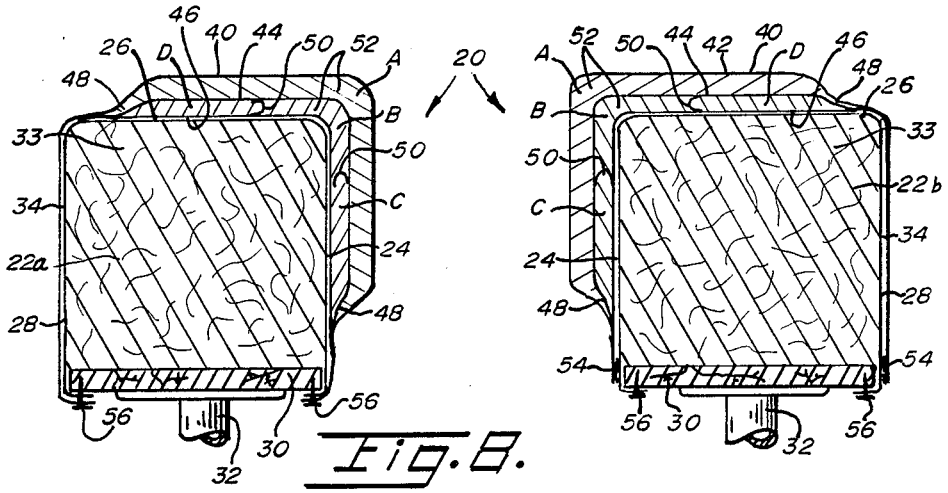
FIG. 8 is a cross-sectional view along lines 8—8 of FIG. 7.
Figure 7:
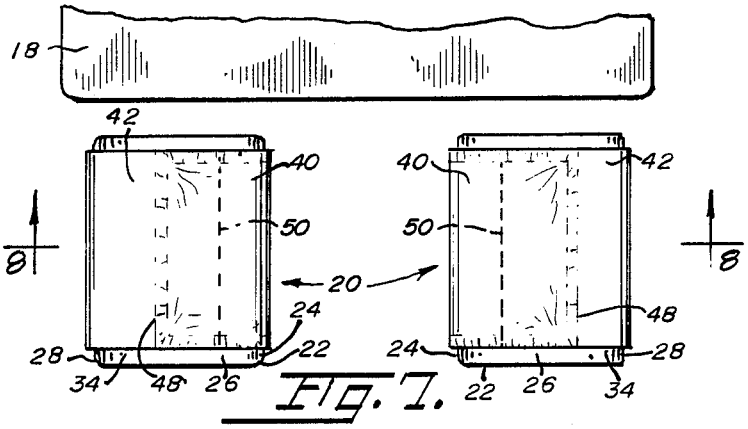
FIG. 7 is a top view of the table (broken away) and headrest having the pillows according to the invention attached thereto.
Figure 10:
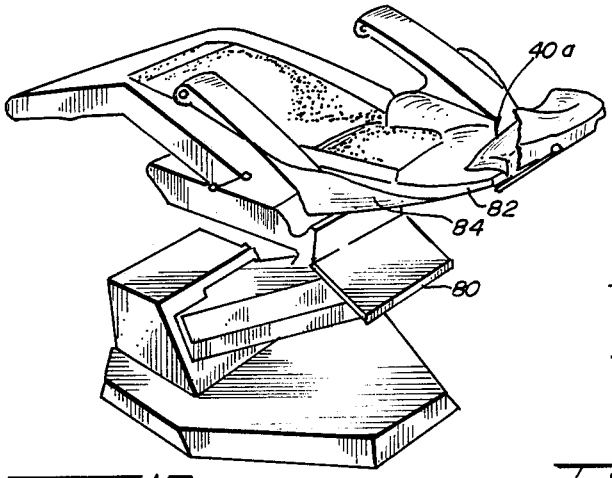
FIG. 10 is a perspective view of a dental chair (headrest broken away) with the pillow of the invention attached to the front top portion of the back support cushion.
Figure 11:
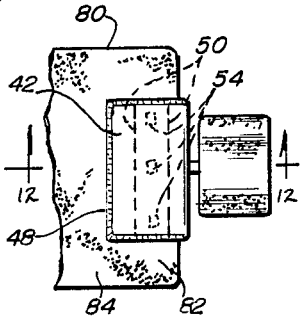
FIG. 11 is a top view of the dental chair (broken away) with the pillow.
Figure 12:
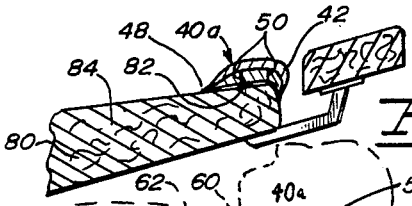
FIG. 12 is a cross-sectional view along lines 12—12 of FIG. 11.

Referring to FIGS. 7 and 8, attachment of pillows 40 to a headrest 20 may illustratively be seen. One of a like pair of pillows 40 is preferably wrapped about inner, top and outer faces 24, 26 and 28 of one of head support pads 22, as shown, so that inner lower subchamber C is adjacent the inner face 24 of head support pad 22 while outer lower subchamber D is adjacent the top face 26 of the head support pad 22. Intermediate lower subchamber B is thereby suitably located at the juncture of inner face 24 and top face 26. The other like pillow 40 of the pair may be similarily fastened to the other head support pad 40.

Various attachment means may be utilized to attach pillows 40 to headrest support pads 22*a* and 22*b* (FIG. 8). VELCRO strips with their complementary and readily interlockable hook and loop pads are quite suitable as an attachment means. That is, the undersides of the longitudinal ends of top plastic film 42 may suitably have VELCRO hook or loop strips 54 affixed thereat. The other complementary VELCRO hook or loop strips 54 may be suitably affixed adjacent or on base 30 of head support pad 22*b*.

Alternatively, top plastic film 42 may be attached to head support pad 22*a* by screws or tacks 56 which also suitably hold the leather or synthetic outer covering 34 over head support pad 22*a*. Buckles or snaps may also be utilized as a fastening or attaching means.

Figure 9:
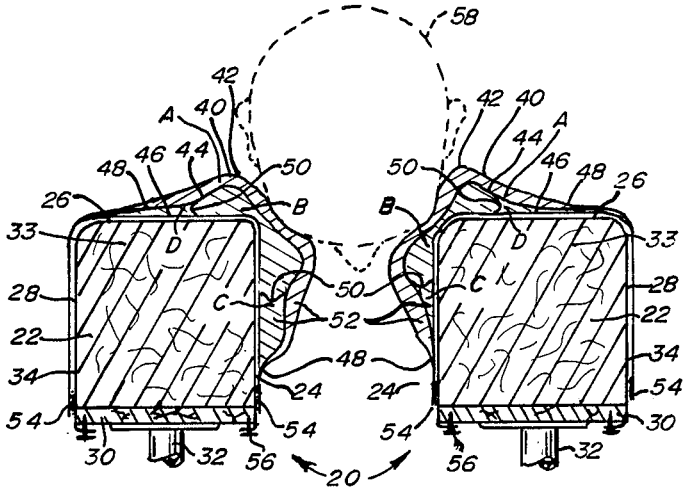
FIG. 9 is the view of FIG. 8 with a person's head facing downward thereon.

Referring to FIG. 9, the operation of the like pair of pillows 40 may be seen with a person's head 58 engaging and being supported and immobilized by pillows 40 appropriately attached to head support pads 22. Typically, the juncture of inner faces 24 and top faces 26 of headrest 20 would uncomfortably concentrate supportive forces on the cheek bones of head 58.

As illustratively shown, top chambers A have a substantial amount of their viscous gel 52 squeezed outwardly from their central regions adjacent the cheek bones of head 58 to the marginal regions of chambers A which are supported underneath by lower subchambers B, C and D. This arrangement increases the head supporting contact surfaces (top films 42) to more evenly distribute support and weight forces between pillows 40 and head 58 in a comfortable manner. In other words, the supportive forces are not solely concentrated on the cheek bones. Pillows 40, filled with viscous gel 52, also help immobilize head 58 because gel 52 tends to hold the conformations or cranial features of head 58 between opposing pads 22.

Referring to FIGS. 10 through 16, a slightly modified embodiment of pillow 40, pillow 40*a*, may be seen suitably attached to the front top portion 82 of back support rest, pad or cushion 84 of conventional dental chair 80.

Pillow 40*a* is like pillow 40 in required elements and construction except intermediate lower subchamber B of pillow 40*a* preferably has more viscous gel therein to thereby create a lateral extending bulge. Also, top plastic film 42 does not extend beyond periphery 48. Bottom plastic film 46 suitably has attachment means, such as beforementioned VELCRO strips 54, attached thereat with the complementary VELCRO strips 54 appropriately attached to the front top portion 82 of back support cushion 84 of chair 80 so that pillow 40*a* will contact the back of the neck or cervical spine 60 when a person is in the supine postion on chair 80. Baffles 50 are preferably transversely aligned with the longitudinal axis of chair 80. In short, pillow 40*a* is rotated 90 degrees compared with pillow 40 for effective cervical spine support and immobilization usage.

Figure 13:
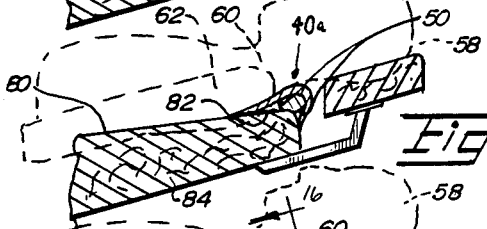
FIG. 13 is the view of FIG. 12 with a person reclining in the dental chair.

More specifically, referring to FIGS. 13, 14, 15 and 16, the operation of pillow 40*a*, which is very much similar to that of pillow 40, may be seen. As a person reclines to the supine position in chair 80, the person's cervical spine 60, between the first thoracic and second cervical vertebrae, is properly support by pillow 40*a*. Bulging intermediate lower subchamber B comfortably supports cervical spine 60 while inner and outer lower subchambers C and D further support upper chamber A as it conforms to, and supports, the natural curvature of a particular person's cervical spine 60 (FIG. 13).

Figure 14:
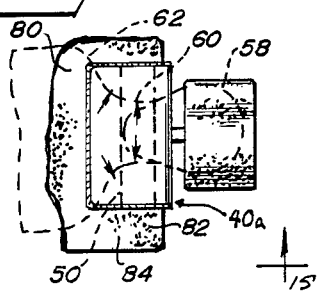
FIG. 14 is a top view of the dental chair (broken away) with a person thereon.
Figure 15:
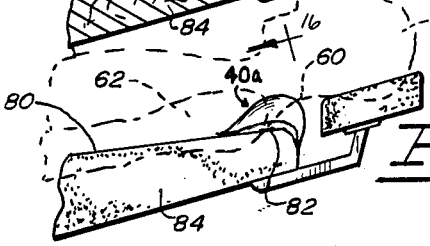
FIG. 15 is a side elevational view of the chair of FIG. 10 (broken away) with a person thereon.
Figure 16:
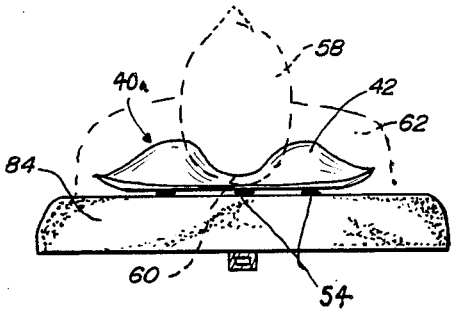
FIG. 16 is a cross-sectional view along lines 16—16 of FIG. 15.

As shown in FIGS. 14, 15 and 16, conforming pillow 40*a* filled with viscous gel not only supports the cervical spine 60, but also helps immobilize spine 60. That is, the gel tends to move or radiate outward from spine 60 as well as from portions of head 58 and shoulders 62 (see arrows in FIG. 14). This gel movement lifts pillow 40*a* about the periphery (broken lines) of cervical spine 60, head 58 and shoulders 62 thereby immobilizing and tending to hold spine 60, head 58 and shoulders 62 stationary.

The present invention may be embodied in other specific forms without departing from the spirit or essential attributes thereof. For example, baffles 50 may not extend the entire width or intermediate and bottom plastic films 44 and 46. If so, the lower subchambers may be formed by sealed, gel-filled inserts between the baffles. Additionally, pillows 40 and 40*a* may be constructed without intermediate film 44. Such an arrangement would create a three chambered pillow that would have many of the characteristics of the preferred four chamber pillows of the invention. Also, pillow 40*a* may be easily adapted to be attached to any device capable of supporting a person in the supine position.

It is therefore desired that the present embodiment be considered in all respects as illustrative and not restrictive, reference being made to the appended claims rather than to the foregoing description to indicate the scope of the invention.

That which is claimed:

1. Pillow adaptable for a headrest having a pair of laterally opposing head support pads each having an inner opposing face and a top face for engagement and support of opposite sides of a head, comprising, (a) a first plastic film having a predetermined length and width;

(b) a second plastic film having a predetermined length and width sealed about its periphery to the first plastic film forming a first closed chamber therebetween;

(c) at least two plastic film baffles within and extending the width of the first chamber sealed to the first and second films forming longitudinally oriented outer, intermediate and inner lower subchambers;

(d) a third plastic film having a predetermined length and width sealed to the first film adjacent the periphery of the second film forming a second closed chamber above the subchambers;

(e) a viscous gel within the outer, intermediate and inner lower subchambers and the second chamber; and (f) means for attaching the pillow to the inner opposing face and the top face of one of the head support pads orienting the inner subchamber adjacent the inner opposing face of the head support pad and the outer subchamber adjacent the top face of the head support pad to comfortably support and immobilize the head.

2. The pillow of claim 1 in combination with a second like headrest pillow for attachment to the inner and top faces of the other head support pad to further confortably support and immobilize the head.

3. The pillow of claim 1 wherein the attachment means are a complementary pair of VELCRO hook and loop strips, one strip of the pair being affixed to the head support pad and the other strip of the pair being affixed to the longitudinal ends of the first film wrapped about the head support pad.

4. The pillow of claim 1 wherein the length of the first film extends beyond the periphery of the second film for wrapping substantially about one of the head support pads.

5. The pillow of claim 4 wherein the attachment means are located at the longitudinal ends of the first film pad on the head support pad.

6. The pillow of claim 1 wherein the plastic films are linear low-density nylon.

7. The pillow of claim 1 wherein the headrest is part of a therapeutic table.

8. The pillow of claim 1 wherein the outer, intermediate and inner lower subchambers are closed.

9. A pillow for headrests having a pair of laterally opposing head support pads each having an inner opposing face and a top face for engagement and support of opposite sides of a head, comprising (a) a top plastic film having a predetermined length and width, (b) an intermediate plastic film having a predetermined length and width sealed about its periphery to the top plastic film forming a closed upper chamber therebetween;

(c) a bottom plastic film having a predetermined length and width sealed about its periphery to the periphery of the intermediate film forming a closed lower chamber therebetween;

(d) at least two plastic film baffles within and extending the width of the lower chamber sealed to the intermediate and bottom films forming longitudinally oriented outer, intermediate and inner lower subchambers;

(e) a viscous gel within the upper chamber and outer, intermediate and inner lower subchambers; and (f) means for attaching the pillow to the inner face and top face of one of the head support pads orientating th inner subchamber adjacent the inner opposing face of the head support pad and the outer subchamber adjacent the top face of the head support pad to comfortably support and immobilize the head.

10. The pillow of claim 9 wherein the outer, intermediate and inner lower subchambers are closed.

11. The pillow of claim 9 in combination with a second like headrest pillow for attachment to the inner opposing face and the top face of the other head support pad to further comfortably support and immobilize the head.

12. The pillow of claim 9 wherein the length of the top film extends beyond the length of the peripheries of the intermediate and bottom films for wrapping substantially about one of the head support pads.

13. The pillow of claim 12 wherein the attachment means are located at the longitudinal ends of the first film and on the head support pad.

14. The pillow of claim 13 wherein the attachment means are a complementary pair of VELCRO hook and loop strips, one strip of the pair being affixed to the head support pad and the other strip of the pair being affixed to the ends of the first film wrapped about the head support pad.

15. The pillow of claim 9 wherein the plastic films are linear low-density nylon.

16. The pillow of claim 9 wherein the headrest is part of a therapeutic table.

17. A pair of pillows for a headrest having a pair of laterally opposing head support pads each having an inner opposing face and a top face for engagement and support of opposite sides of a head, each pillow comprising (a) a top plastic film having a predetermined length and width, the length being sufficient for wrapping substantially about one of the head support pads;

(b) an intermediate plastic film having a predetermined length and width sealed about its periphery to the top plastic film forming a closed upper chamber therebetween;

(c) a bottom plastic film having a predetermined length and width sealed about its periphery to the periphery of the intermediate film forming a closed lower chamber therebetween;

(d) at least two plastic film baffles within and extending the width of the lower chamber sealed to the intermediate and bottom films forming longitudinally oriented outer, intermediate and inner lower subchambers;

(e) a viscous gel within the upper chamber and outer, intermediate and inner lower subchambers;

(f) means located at the longitudinal ends of the top film and on the head support pads for attaching the pillow to the inner face and the top face of one of the head support pads orientating the inner subchamber adjacent the inner face surface of the head support pad and the outer subchamber adjacent the top face of the head support pad to comfortably support and immobilize the head.

18. The pair of pillows of claim 17 wherein the plastic films are linear low-density nylon.

19. The pair of pillows of claim 17 wherein the headrest is part of a therapeutic table.

20. A pillow for engaging support and immobilization of the cervical spine of a person in a supine position, comprising (a) a top plastic film having a predetermined length and width;

(b) an intermediate plastic film having a predetermined length and width sealed about its periphery to the top plastic film forming a closed upper chamber therebetween;

(c) a bottom plastic film having a predetermined length and width sealed about its periphery to the periphery of the intermediate film forming a closed lower chamber therebetween;

(d) at least two plastic film baffles within and extending the width of the lower chamber sealed to the intermediate and bottom films forming laterally oriented outer, intermediate and inner lower subchambers; and (e) a viscous gel within the upper chamber and outer, intermediate and inner lower subchambers.

21. The pillow of claim 20 wherein the pillow is adaptable for releasably attaching to the front top portion of the back cushion of a dental chair.

22. The pillow of claim 20 wherein the outer, intermediate and inner subchambers are closed.

* * * * *